United States Patent [19]

Zaderej

[11] Patent Number: 4,626,746

[45] Date of Patent: Dec. 2, 1986

[54] POWER CONTROL CIRCUIT

[76] Inventor: Andrew Zaderej, 4016 N. Home St., Mishawaka, Ind. 46544

[21] Appl. No.: 747,168

[22] Filed: Jun. 20, 1985

Related U.S. Application Data

[63] Continuation of Ser. No. 401,706, Jul. 26, 1982, abandoned.

[51] Int. Cl.[4] ..... H05B 37/00

[52] U.S. Cl. ..... 315/208; 315/194; 315/199; 315/226; 315/287; 315/DIG. 4

[58] Field of Search ..... 315/DIG. 4, 287, 208, 315/194, 199, 226

[56] References Cited

U.S. PATENT DOCUMENTS

| | | | |
|---|---|---|---|
| 3,147,928 | 9/1964 | Carpenter | 315/194 |
| 3,317,789 | 5/1967 | Nuckolls | 315/194 |
| 3,358,186 | 12/1967 | Nomura | 315/194 |
| 3,514,667 | 5/1970 | Dessoulavyet | 315/194 |
| 4,052,648 | 10/1977 | Nola | 318/810 |
| 4,170,747 | 10/1979 | Holmes | 315/287 |
| 4,379,254 | 4/1983 | Hurban | 315/307 |

*Primary Examiner*—Harold Dixon

*Attorney, Agent, or Firm*—Reising, Ethington, Barnard, Perry & Milton

[57] ABSTRACT

A power control circuit which receives an AC line signal input and includes operational amplifiers which receive the AC line signal after it has been rectified. Each operational amplifier respectively operates as a zero crossing circuit which produces a square synchronous pulsed signal, a ramp generator which receives the square synchronous pulsed signal and produces a sawtooth wave signal, a comparator which receives the sawtooth wave signal and produces a synchronous pulsed width modulated output signal which can be varied. A power bridge circuit receives the AC line signal input and is triggered by the pulsed width modulated signal to rectify the AC line input to pass a pulsed width modulated signal to the load. The signal passed to the load is varied by the setting of the comparator.

13 Claims, 4 Drawing Figures

POWER CONTROL CIRCUIT

This is a continuation of application Ser. No. 401,706 filed on July 26, 1982, now abandoned.

SUMMARY OF THE INVENTION

This invention relates to a power control which will have specific but not limited application to fluorescent lighting and electric motors.

Heretofore devices used to control the electrical power input into such components as fluorescent lights have been limited as to range of effective usage. In the subject invention the power control has a wide range of usage to enable the output of a fluorescent light to be significantly reduced without flicker and to be used with such power devices as AC and DC motors.

The power control which receives an AC line input, a zero crossing circuit which produces a square synchronous pulsed signal, a ramp generator which receives the square pulsed signal and produces a sawtooth wave form signal, a comparator which receives the sawtooth wave signal and produces a synchronous pulsed width modulated output signal, and a power bridge circuit triggered by the pulsed width modulated signal which rectifies the AC line input and transmits a pulsed width modulated output for the load. The width of the pulsed AC is determined by the width of the pulsed width modulated DC signal from the comparator. The signal output of the comparator can be varied to produce a variable pulsed AC output.

In a specific application of the power control of this invention to a fluorescent lamp, the power required to operate the lamp can be reduced up to at least 50 percent without producing a flickering in the lamp. Also, the AC input is symmetrically reduced in being rectified into the pulsed width AC output to cause an even energization of ions in a fluorescent lamp, thereby reducing blackening of the ends of the lamp bulb.

Accordingly, it is an object of this invention to provide a novel and useful electrical power control.

Another object of this invention is to provide a power control which produces symmetrical duty cycle reduction of an AC signal.

Another object of this invention is to provide a control which can be used to vary the duty cycle of the power input into an electrical device.

Yet another object of this invention is to provide a power control which can be used to substantially reduce the power requirement of an electrical device and yet not significantly affect the performance of the electrical device.

Other objects of this invention will become apparent upon a reading of the following description.

DESCRIPTION OF THE PREFERRED EMBODIMENT

The preferred embodiments illustrated are not intended to be exhaustive or to limit the invention to the precise forms disclosed. They are chosen and described in order to best explain the principles of the invention and its application and practical use to thereby enable others skilled in the art to utilize the invention.

Figure 1:
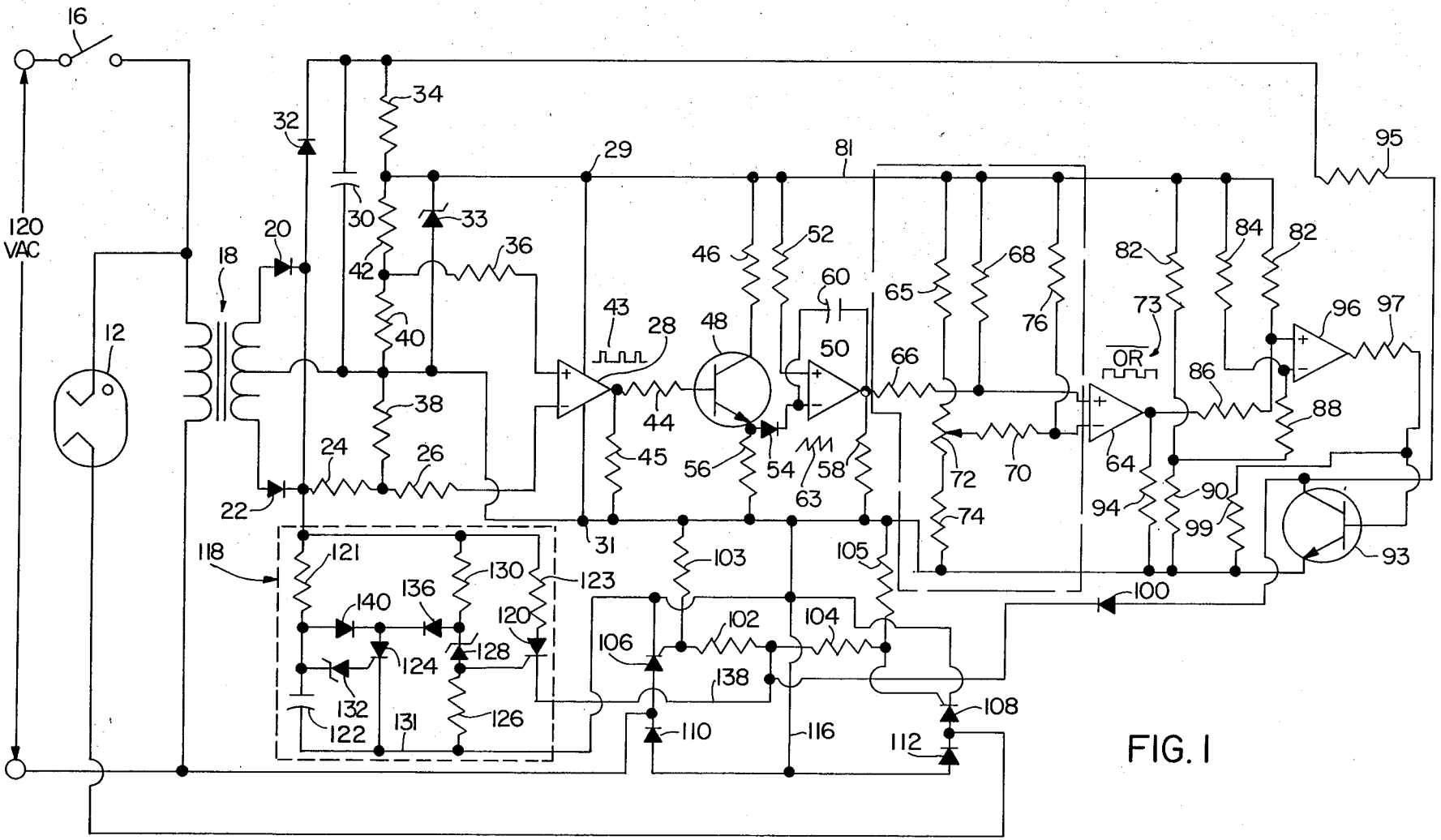
FIG. 1 is a circuit diagram of one embodiment of the power control of this invention.
Figure 2:
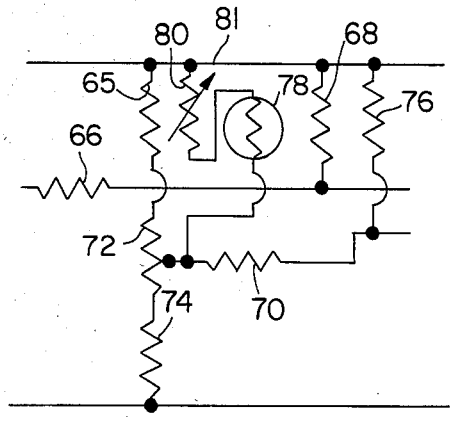
FIG. 2 is a fragmentary circuit diagram of an alternative power command setting for use in the circuit of FIG. 1.

Description of the Circuits of FIGS. 1 and 2

The power control shown in FIGS. 1 and 2 may be used to regulate the power input into a fluorescent lamp 12. The input to the circuit is ordinary AC line voltage, such as the 120 volt/60 cycle input shown. A switch 16 connects the power input to a step-down transformer 18 which, for example, reduces the power input to approximately 16 volts which is divided. The secondaries of transformer 18 are connected to rectifying diodes 20, 22 which produce a full wave rectified signal. The full wave rectified signal is fed through resistors 24, 26 into the negative input of operational amplifier 28. The positive input of operational amplifier 28 receives a true or substantially no-ripple DC signal derived from the full wave rectified DC signal output of diodes 20, 22 by the filtering operation of capacitor 30, diode 32, zener diode 33, and resistor 34. Zener diode 33 provides a regulated true DC power supply across junctions 29, 31 of amplifier 28. Resistors 24, 26, 36, 38, 40 and 42 provide a proper biasing for amplifier 28.

Operational amplifier 28 is a part of a zero crossing circuit and functions in a differential mode which compares the full wave rectified DC signal at its negative input to the true DC signal at its positive input and produces a square synchronous pulsed signal 43 at its output. The output signal of amplifier 28 has a high rise due to the true DC signal provided at the positive input of the amplifier. The output signal of operational amplifier 28 passes into NPN transistor 48 biased by resistor 44, 45, and 46 and is amplified and cleaned.

The square synchronous pulsed signal from the emitter of transistor 48 passes through blocking diode 54 and into the negative input terminal of operational amplifier 50. A true DC signal is received by the positive input terminal of amplifier 50 with the amplifier and its associated resistors 52, 56, and 58 and capacitor 60 serving as a ramp generator circuit which produces a synchronous sawtooth output wave form 63.

The sawtooth signal output of amplifier 50 passes into the positive input terminal of operational amplifier 64. Resistors 65, 66, 68, 70, 74, and 76 provide current limiting and the proper biasing for operational amplifier 64. A potentiometer 72 is used to regulate the true DC input into the negative input terminal of operational amplifier 64.

Operational amplifier 64 performs a comparator function and produces a pulsed width modulated DC output signal 73 whose duty cycle can be varied from 100 percent, or continuous, DC to an infinitesimal pulsed DC by the setting of the potentiometer 72. An alternative circuit for varying the pulsed width modulated signal is shown in FIG. 2 and includes a photoresistor 78 and a variable resistor 80 connected between potentiometer 72 and the true DC power source at conductor 81. Resistor 78 is responsive to the ambient light level about the resistor and automatically varies the duty cycle of the pulsed width modulated signal which, as will be described, serves to vary the intensity of lamp 12.

An operational amplifier 96 is provided to receive the pulsed width modulator signal from amplifier 64. Resistors 82, 84, 86, 88, 90, 92, 94 provide the proper biasing for amplifier 96. Amplifier 96 performs the optional function of filtering out the noise in the pulsed width modulated output signal of amplifier 64 and provides added isolation for the signal. The base of an NPN transistor 93 receives the pulse width modulated signal from amplifier 96. Resistors 95, 97, 99 serve to bias transistor 93 which amplifies the current of the received signal.

An SCR-diode bridge circuit is used to reduce the AC power input to lamp 12 and includes SCR's 106, 108, resistors 102, 103, 104, 105, which provide proper biasing for SCR's 106, 108, and diodes 110, 112 connected in the modes shown. The amplified, synchronous pulse width modulated signal from transistor 93 passes through blocking diode 100 and to the gates of SCR's 106, 108 to cause the SCR's to be triggered on during the transmission peaks of the modulated signal. When SCR's 106, 108 are triggered, the positive portion of the AC line signal passes through SCR 106, across jumper 116, through diode 112 and on to fluorescent lamp 12. The negative portion of the AC line signal then passes through diode 110, across jumper 116, through SCR 108 and on to lamp 12. The resultant signal to the lamp is a pulsed AC where the pulse width of the AC current is determined by the time SCR's 106, 108 are on, which, in turn, is determined by the pulse width of the modulated signal from transistor 93. By varying the DC input into amplifier 64 at its negative input terminal, the intensity of fluorescent lamp 12 may be varied from a full intensity to a very low intensity.

Upon starting, fluorescent lamp 12 requires a full wave AC signal. This signal is provided by timing circuit 118. Timing circuit 118 includes an SCR 120 which connects the rectified full wave output of transformer 18 to the gates of bridge circuit SCR's 106, 108, a timing resistor 121 and capacitor 122, turn-off device or SCR 124, gating branch resistors 126, 130, zener diodes 128, 132, load resistor 123, short circuit SCR 132, and signal blocking diodes 136, 140, all connected in the mode and manner shown.

Upon the turn-on of switch 16, a full wave rectified signal is fed into timing circuit 118 and short circuit SCR-120 is switched on to permit the full wave rectified signal to enter the SCR-diode circuit at conductor 138 and override the pulse width modulated signal from transistor 93. After a selected time duration to bring the fluorescent lamps to full power, timing capacitor 122 is charged and the breakdown point of zener diode 132 is exceeded to turn on SCR 124. This causes SCR 120 to be turned off due to the current signal being directed through SCR 120 because of resistor value selection. Upon SCR 120 turn-off, the full wave signal to the power bridge circuit is terminated, allowing the selected pulsed width modulated signal from transistor 93 to control the power input into lamp 12.

Figure 4:
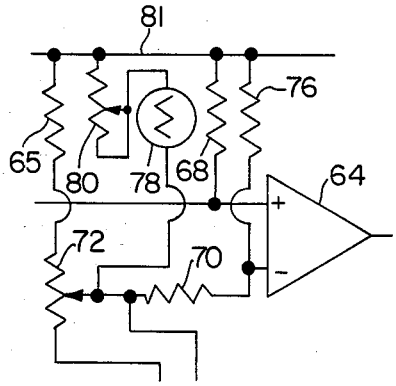
FIG. 4 is a fragmentary circuit diagram of an alternative power command setting for use in the circuit of FIG. 3.
Figure 3:
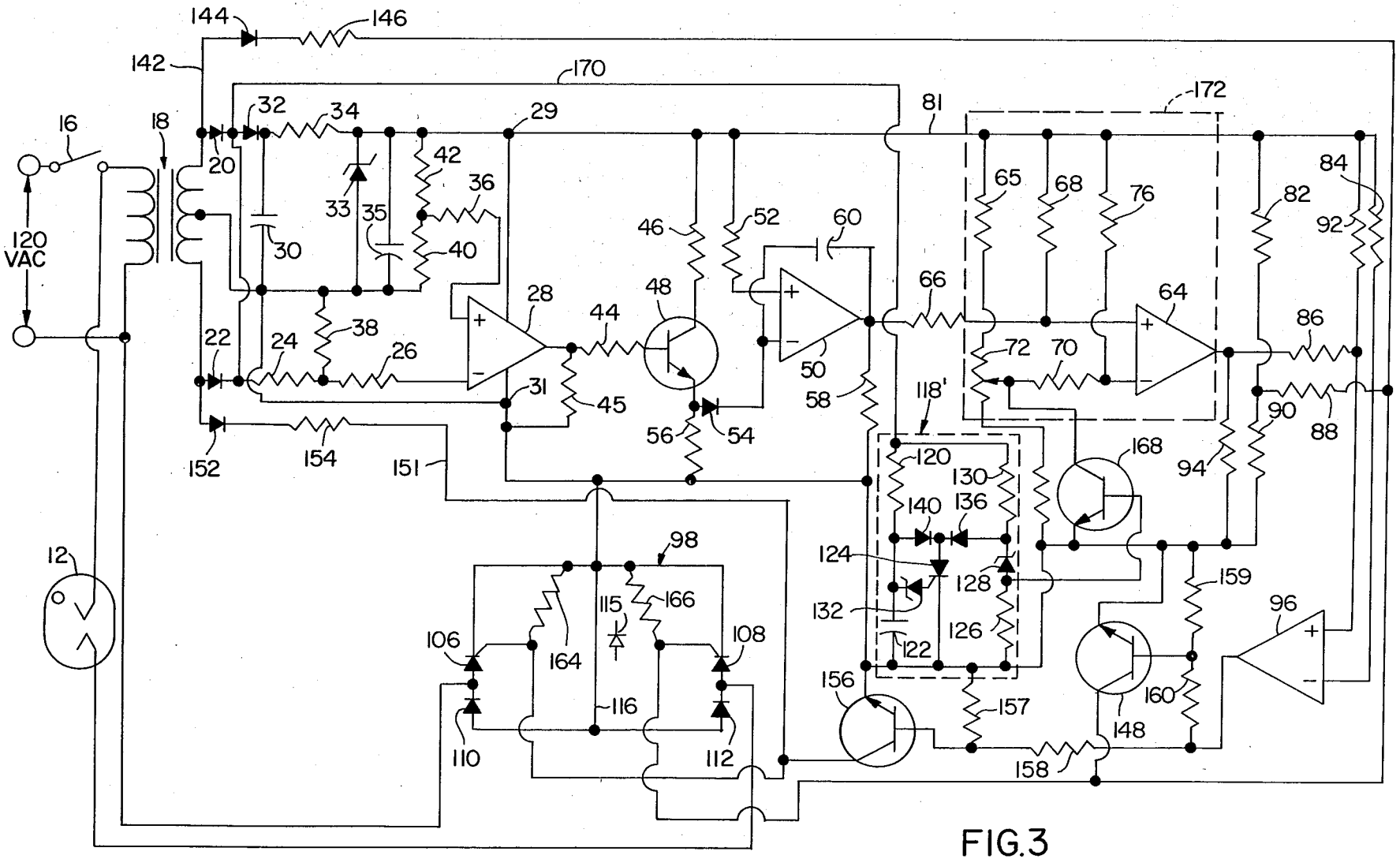
FIG. 3 is a circuit diagram of a second embodiment of the power control of this invention.

Description of the Circuits of FIGS. 3 and 4

FIG. 3 illustrates a second embodiment of the power control which includes operational amplifiers 28, 50, 64, and 96 which perform the same functions as described in the description of circuit of FIGS. 1 and 2. The components of this embodiment perform the same functions as the same or like numbered components of FIG. 1. An additional capacitor 35 is placed in parallel with zener diode 33 to improve the filtering of the rectified signal to amplifier 28.

In this circuit embodiment NPN transistors 148 and 156 with associated biasing and current limiting resistors 157, 158, 159, 160 are used to gate SCR's 106, 108 biased by resistors 164, 166. Conductors 142, 151 through associated blocking diodes 144, 152 and conductor resistors 146, 154 extend from opposite secondaries of transformer 18 to the gate of an SCR 106 or 108 and to the collector of a transistor 148 or 156. The base of each transistor 148, 156 receives the pulse width modulated signal output of amplifier 96, and the emitters of the transistors are connected to virtual ground. Upon the pulsed application of the modulated signal from amplifier 96 to the base of each transistor 148, 156, the transistors will short the synchronous half wave AC rectified signal in each conductor 142, 151 to virtual ground and away from the power bridge circuit 98. This prevents triggering or shut-off of SCR's 106, 108 to reduce the duty cycle or width of the AC signal passing from the power input through the power bridge circuit 98 to lamp 12. In this manner, transistors 148 and 156 serve to synchronously switch power bridge circuit SCR's 106 and 108 for providing a pulsed width modulated AC current signal to lamp 12 as described for the circuit in FIG. 1.

To begin operation of the lamp 12, a full AC signal is required to bring the lamp up to full power. For this purpose, a timer circuit 118' is provided. Timer circuit 118' includes the same components which perform essentially the same as in timer circuit 118 of FIG. 1 except that a transistor 168 is incorporated for SCR 120. The emitter of transistor 168 is connected to a virtual ground and the collector thereof is connected between resistors 70 and potentiometer 72 in front of operational amplifier 64. The base of transistor 168 is connected between zener diode 128 and resistor 126 in timer circuit 118'. Upon power turn-on, the full wave rectified signal in conduit 170 passes through resistor 130 and zener diode 128 to the base of transistor 168, causing the transistor to turn on and pass the DC signal intended for the negative input terminal of amplifier 64 to ground. This causes the output of amplifiers 64 and 96 to be continuous DC which in turn causes transistors 148, 156 to be turned on with a resulting full wave AC signal being supplied to lamp 12. When timing capacitor 122 is charged, the breakdown point of zener diode 132 is exceeded and SCR 124 switched on. This, as previously explained for the circuit of FIG. 1, reduces the current signal to the base of transistor 168 and turns the transistor off to allow amplifier 64 to resume its normal intended output depending upon the setting of potentiometer 72.

FIG. 4 is an alternative circuit for varying the pulsed width modulated signal output of amplifier 64. It has the same components and functions in the same manner as was described for the circuit of FIG. 2. The circuit of FIG. 4 is substituted for that portion of the circuit of FIG. 3 within broken line box 172.

The power control circuits of FIGS. 1 and 2 may be utilized to regulate an AC motor connected in place of lamp 12. A DC motor can also be controlled with slight modification of the circuits of this invention. A free wheeling diode 115 will be placed in conductor 116 of the power bridge circuit of FIG. 3 (see illustration) and the DC motor will be connected across the diode 115.

It is to be understood that the invention is not to be limited by the terms of the above description but may be modified within the scope of the appended claims.

What I claim is:

1. An electrical power control comprising rectifier means for receiving an AC power supply input and producing a rectified signal, zero crossing circuit means for receiving said rectified signal and producing a square synchronous pulsed signal therefrom, ramp generator circuit means for receiving said square synchronous pulsed signal and producing a synchronous sawtooth output wave form signal, comparator circuit means for receiving said sawtooth output wave form signal along with a second signal and producing a pulsed width modulated signal in which the width of said modulated signal is varied in response to the value of said second signal, means for selectively varying said second signal into said comparator circuit means, bridge circuit means responsive to said modulated signal for receiving said AC power supply input and regulating the duty cycle of said AC power supply input to produce a reduced power AC output in response to said width of said modulated signal, said bridge circuit means including two SCRs, the cathode of one of said SCRs being connected by a first conductor to the cathode of the other of said SCRs, two diodes, the anode of one of said diodes connected by a second conductor to the anode of the other of said diodes, the cathode of each of said diodes connected to the anode of a said SCR, a jumper extending between said first and second conductors, a third conductor connected at the junction of the cathode of said one diode and the anode of the diode connected SCR, a fourth conductor connected at the junction of the cathode of said other diode and the anode of the diode connected SCR, said third and fourth conductors adapted for connection in series with an AC power source for producing said AC power supply input and a load, said SCRs including gate means responsive to said modulated signal for reducing the duty cycle of said AC power supply input and reducing the duty cycle of said AC power supply input and thereby the power to said load.

2. The invention as defined in claim 1 including second rectifier means for receiving said AC power supply input and producing separate 180 degrees out-of-phase half wave rectified signals, fifth and sixth conductors connected between said second rectifier means and said gate means of said SCRs to trigger each SCR with a said separate half wave signal, first and second NPN transistors each having their bases connected to said comparator circuit means for receiving said modulated signal, the emitter of each transistor connected to a ground, the collector of said first transistor connected to said fifth conductor to divert said separate half wave signal therein to ground and to turn off said associated SCR when the base of the first transistor receives said modulated signal, the collector of said second transistor connected to said sixth conductor to divert said separate half wave signal therein to ground and to turn off said associated SCR when the base of the second transistor receives said modulated signal.

3. An electrical power control comprising rectifier means for receiving an AC power supply input and producing a rectified signal, zero crossing circuit means for receiving said rectified signal and producing a square synchronous pulsed signal therefrom, ramp generator circuit means for receiving said square synchronous pulsed signal and producing a synchronous sawtooth output wave form signal, comparator circuit means for receiving said sawtooth output wave form signal along with a second signal and producing a pulsed width modulated signal in which the width of said modulated signal is varied in response to the value of said second signal, means for selectively varying said second signal into said comparator circuit means, bridge circuit means responsive to said modulated signal for receiving said AC power supply input and regulating the duty cycle of said AC power supply input to produce a reduced power AC output in response to said width of said modulated signal, said bridge circuit means including two SCRs, the cathode of one of said SCRs being connected by a first conductor to the cathode of the other of said SCRs, two diodes, the anode of one of said diodes connected by a second conductor to the anode of the other of said diodes, the cathode of each of said diodes connected to the anode of a said SCR, a jumper extending between said first and second conductors, a third conductor connected at the junction of the cathode of said one diode and the anode of the diode connected SCR, a fourth conductor connected at the junction of the cathode of said other diode and the anode of the diode connected SCR, said third and fourth conductors adapted for connection in series with an AC power source for producing said AC power supply input and a load, said SCRs including gate means responsive to said modulated signal for reducing the duty cycle of said AC power supply input and thereby the power to said load, said zero crossing circuit means includes an operational amplifier which receives a substantially ripple-free DC signal at one input and a full wave rectified signal at another input to produce said square synchronous pulsed signal at its output.

4. The invention as defined in claim 3 wherein said ramp generator circuit means includes a second operational amplifier which receives said square synchronous pulsed signal at one input and said ripple-free DC signal at another input to produce said synchronous sawtooth output wave form.

5. The invention as defined in claim 4 wherein said comparator circuit means includes a third operational amplifier which receives said synchronous sawtooth output wave form at one input and said ripple-free DC signal at another input to produce said modulated signal in response to the value of said ripple-free DC signal, said means for varying said second signal including means for selectively varying said ripple-free DC signal to vary the duty cycle of said modulated signal.

6. The invention as defined in claim 5 wherein said means for varying said ripple-free DC signal includes a variable signal limiter responsive to the output of ambient light about said limiter.

7. The invention as defined in claim 1 including a timing circuit means for triggering said SCRs to cause said AC power supply input to have a full duty cycle for a selected period of time.

8. The invention as defined in claim 1 wherein said bridge circuit means includes two SCRs, the cathode of one of said SCRs being connected by a first conductor to the cathode of the other of said SCRs, two diodes, the anode of one of said diodes connected by a second conductor to the anode of the other of said diodes, the cathode of each of said diodes connected to the anode of a said SCR, a jumper extending between said first and second conductors, a third conductor connected at the junction of the cathode of said one diode and the anode of the diode connected SCR, a fourth conductor connected at the junction of the cathode of said other diode and the anode of the diode connected SCR, said third and fourth conductors adapted for connection in series with an AC power source for producing said AC power supply input and a load, said SCRs including gate means responsive to said modulated signal for reducing the duty cycle of said AC power supply input and thereby the power to said load.

9. A power control circuit for controlling the effective voltage applied from an AC voltage source to a load device comprising:

a full wave rectifier circuit comprising a pair of terminals, first and second SCRs connected in series with each other in a first series circuit between said terminals, first and second diodes connected in series with each other in a second series circuit between said terminals, said first series circuit being in parallel with said second series circuit, the cathodes of said SCRs being coupled together at a first junction and the anodes of said diodes being connected together at a second junction, and conductive means connecting said first and second junctions together, said load device being connected in series combination with said full wave rectifier circuit, said series combination being adapted for connection across said voltage source, control voltage means adapted to be connected with said AC voltage source for developing a pulse width modulated control voltage in synchronism with the AC voltage source, turn-on voltage means for applying a turn-on voltage to the gates of said SCRs, and switching means for coupling said gates to a point of reference potential to hold the SCRs turned off, said control voltage means being coupled with said switching means for controlling the conduction angle of said SCR in correspondence with the modulation of said control voltage.

10. The invention as defined in claim 9 including means for varying the pulse width modulation of said control voltage.

11. The invention as defined in claim 9 wherein said switching means is a transistor.

12. The invention as defined in claim 9 wherein said turn-on voltage means comprises a full wave rectifier coupled with said AC voltage source.

13. The invention as defined in claim 9 wherein said turn-on voltage means comprises a full wave rectifier and a voltage dividing means connected across a full wave rectifier, said gates being coupled with said voltage dividing means, said switching means being connected across said voltage dividing means to short circuit it when the switching means is closed.

* * * * *